US007666024B2

(12) United States Patent
De France

(10) Patent No.: US 7,666,024 B2
(45) Date of Patent: Feb. 23, 2010

(54) SPRING LOADED PARALLEL PAD CLAMP

(75) Inventor: Robert V. De France, Poughkeepsie, NY (US)

(73) Assignee: Burndy Technology LLC, Manchester, NH (US)

( * ) Notice: Subject to any disclaimer, the term of this patent is extended or adjusted under 35 U.S.C. 154(b) by 35 days.

(21) Appl. No.: 12/026,089

(22) Filed: Feb. 5, 2008

(65) Prior Publication Data

US 2008/0194153 A1 Aug. 14, 2008

Related U.S. Application Data

(60) Provisional application No. 60/901,052, filed on Feb. 13, 2007.

(51) Int. Cl.
*H01R 13/00* (2006.01)

(52) U.S. Cl. ..... 439/479

(58) Field of Classification Search ..... 439/477–479, 439/781–782

See application file for complete search history.

(56) References Cited

U.S. PATENT DOCUMENTS

| | | | | |
|---|---|---|---|---|
| 1,603,035 | A | 10/1926 | Evans | |
| 2,107,061 | A | 2/1938 | Pittman et al | |
| 2,120,447 | A | 6/1938 | Tipsord | |
| 2,151,524 | A | 3/1939 | Pittman et al | |
| 2,206,653 | A | 7/1940 | Yonkers | |
| 2,530,299 | A | 11/1950 | Hendley | |
| 2,651,766 | A | 9/1953 | Runde | |
| 2,811,703 | A | 10/1957 | Becker | |
| 2,867,787 | A | 1/1959 | Nilsson | |
| 3,075,166 | A | 1/1963 | Peek | |
| 3,177,459 | A | 4/1965 | Toedtman | |
| 4,293,176 | A * | 10/1981 | Lindlof | 439/413 |
| 4,707,051 | A * | 11/1987 | Hall | 439/781 |
| D329,244 | S | 9/1992 | Dinkel | D13/149 |
| 7,160,142 | B2 | 1/2007 | Hughes et al. | 439/479 |
| 2002/0173195 | A1 * | 11/2002 | Burger | 439/362 |

FOREIGN PATENT DOCUMENTS

| | | | |
|---|---|---|---|
| JP | 08308071 | A | 11/1996 |
| JP | 10042438 | A | 2/1998 |
| JP | 2001136643 | A | 5/2001 |

OTHER PUBLICATIONS

Burndy Products Catalog, p. E15.

* cited by examiner

*Primary Examiner*—Renee S Luebke
*Assistant Examiner*—Larisa Tsukerman
(74) *Attorney, Agent, or Firm*—Harrington & Smith PC

(57) ABSTRACT

Disclosed herein is an electrical connector. The electrical connector includes an upper pad, a lower pad, a fastener, and a spring. The upper pad includes a first upper groove, a second upper groove, and an upper hole. The upper hole extends through the upper pad between the first upper groove and the second upper groove. The lower pad includes a first lower groove, a second lower groove, and an elongated hole. The elongated hole extends through the lower pad between the first lower groove and the second lower grove. The fastener extends through the upper hole and the elongated hole. The spring is between the fastener and the lower pad. The spring is configured to bias the upper pad and the lower pad towards each other. The lower pad is configured to be pivotable around the fastener, and relative to the upper pad, at the elongated hole.

25 Claims, 4 Drawing Sheets

SPRING LOADED PARALLEL PAD CLAMP

CROSS REFERENCE TO RELATED APPLICATION

This application claims priority under 35 U.S.C. §119(e) to U.S. provisional patent application No. 60/901,052 filed Feb. 13, 2007 which is hereby incorporated by reference in its entirety.

BACKGROUND OF THE INVENTION

1. Field of the Invention

The invention relates to an electrical connector and, more particularly, to a spring loaded parallel pad clamp.

2. Brief Description of Prior Developments

Power line clamp connectors for making a connection to an overhead power distribution lines are known in the art. U.S. Pat. No. 3,075,166 discloses a conventional hot line clamp having a threaded eye bolt for adjusting a clamping member. One drawback to the conventional configurations is that complex maneuvering of a utility lineman's hot stick is required to manipulate the eyebolt for clamp installation. As maintenance and installation operations become increasingly difficult, the added time required for these operations can increase operating costs for the utility company.

Accordingly, there is a need for an improved power line clamp which allows for facilitated installation.

SUMMARY OF THE INVENTION

In accordance with one aspect of the invention, an electrical connector is disclosed. The electrical connector includes an upper pad, a lower pad, a fastener, and a spring. The upper pad includes a first upper groove, a second upper groove, and an upper hole. The upper hole extends through the upper pad between the first upper groove and the second upper groove. The lower pad includes a first lower groove, a second lower groove, and an elongated hole. The elongated hole extends through the lower pad between the first lower groove and the second lower grove. The fastener extends through the upper hole and the elongated hole. The spring is between the fastener and the lower pad. The spring is configured to bias the upper pad and the lower pad towards each other. The lower pad is configured to upper pad, at the elongated hole.

In accordance with another aspect of the invention, an electrical connector clamp is disclosed. The electrical connector clamp includes an upper pad, a lower pad, a fastener, and a spring. The upper pad includes a first flange. A first side of the upper pad is configured to contact an upper portion of a first conductor and an upper portion of a second conductor. The lower pad includes a second flange. A first side of the lower pad is configured to contact a lower portion of the first conductor and a lower portion of the second conductor. The fastener is connected between the upper pad and the lower pad. The spring is at a second side of the lower pad connected to the fastener. The clamp is configured to receive the second conductor between the first flange and the second flange against a bias of the spring after the first conductor is received between the upper pad and the lower pad.

In accordance with another aspect of the invention, a method of manufacturing an electrical connector is disclosed. An upper pad including a first upper groove, a second upper groove, and an upper hole is provided. The upper hole extends through the upper pad between the first upper groove and the second upper groove. A lower pad including a first lower groove, a second lower groove, and an elongated hole is provided. The elongated hole extends through the lower pad between the first lower groove and the second lower grove. A fastener is connected to the upper pad and the lower pad. The fastener extends through the upper hole and the elongated hole. A spring is connected between the fastener and the lower pad. The spring is configured to bias the upper pad and the lower pad towards each other. The lower pad is configured to be pivotable around the fastener, and relative to the upper pad, at the elongated hole.

BRIEF DESCRIPTION OF THE DRAWINGS

The foregoing aspects and other features of the invention are explained in the following description, taken in connection with the accompanying drawings, wherein.

DETAILED DESCRIPTION OF THE PREFERRED EMBODIMENTS

Figure 1:
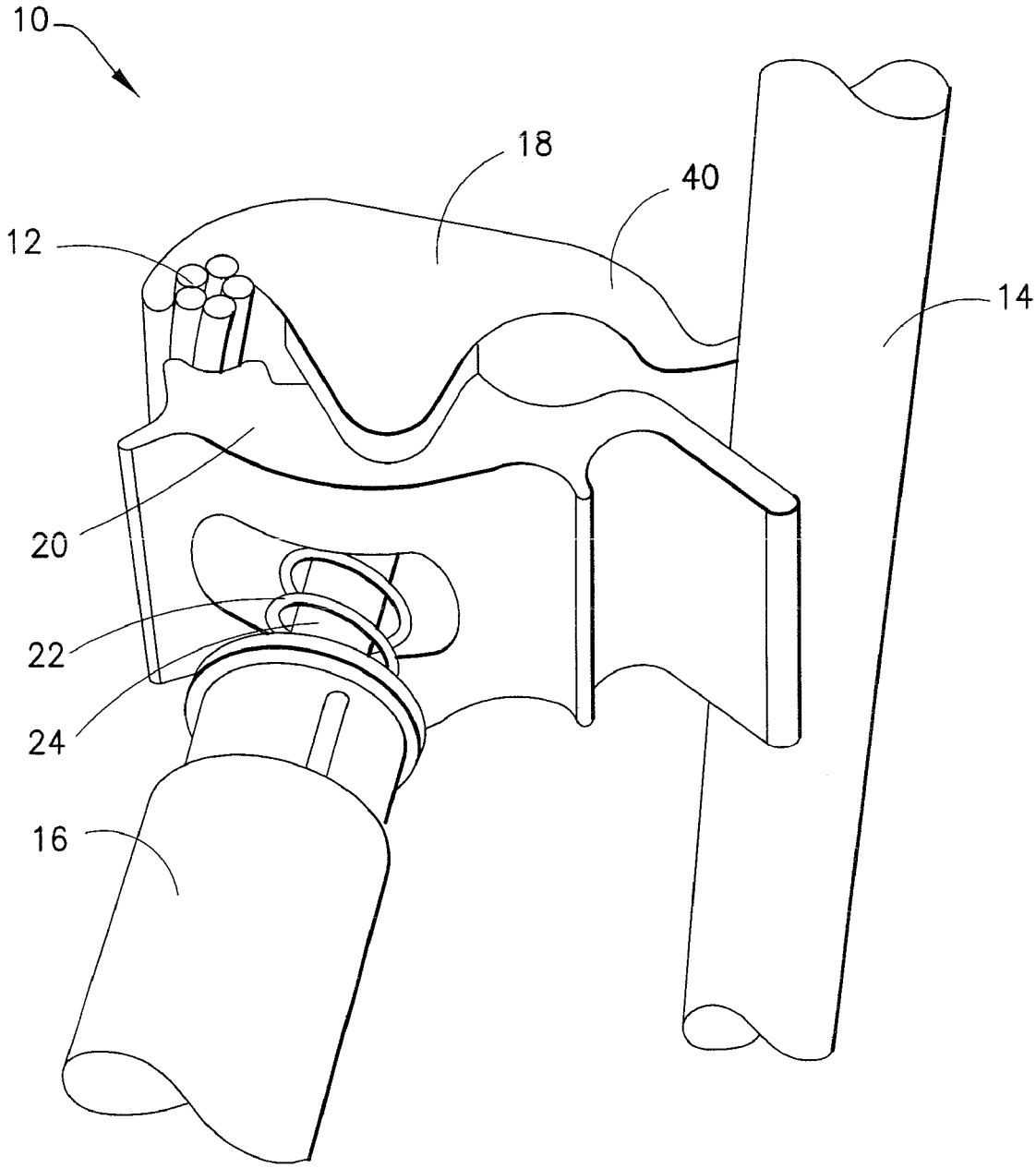
FIG. 1 is a perspective view of a spring loaded parallel pad clamp having a first conductor in an installed configuration and a second conductor in a pre-installed configuration.

Referring to FIG. 1, there is shown a perspective view of a spring loaded parallel pad clamp 10 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

As shown in FIG. 1, the spring loaded parallel clamp 10 is configured to electrically connect a first electrical conductor 12 to a second electrical conductor 14. FIG. 1 depicts the first conductor 12 in an installed position and the second conductor 14 in a pre-installation position. The second conductor 14 may be a main conductor such as a run cable or feeder cable, and the first conductor 12 may be a tap line or tap conductor. However, it should be understood that any combination of conductor types or sizes may be accommodated such as Aluminum Cable Steel Reinforced (ACSR), copper, aluminum, aluminum alloy 6201, and aluminum alloy 5005, for example. The spring loaded parallel clamp 10 provides for an improved clamp connector which may be installed using a utility lineman's hot stick 16.

The spring loaded parallel clamp 10 includes an upper pad 18, a lower pad 20, a spring 22, and a fastener 24. The fastener 24 secures the spring 22 against the lower pad 20 to bias the two pads 18, 20 towards each other. The spring bias also provides a clamping force to secure the two conductors 12, 14 between the upper pad 18 and the lower pad 20.

Figure 2:
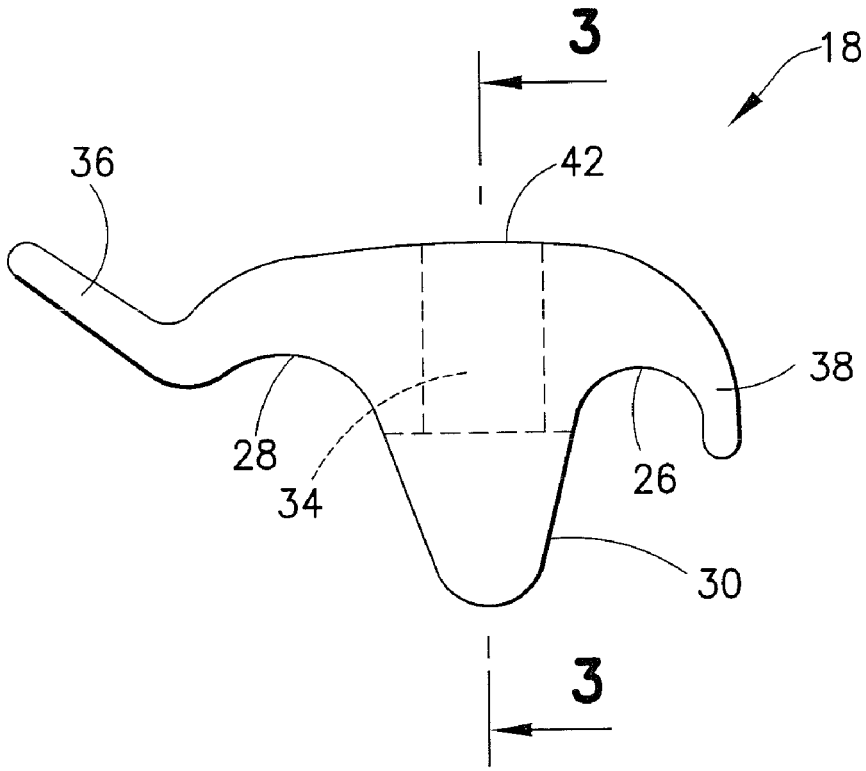
FIG. 2 is a side elevational view of an upper pad used in the spring loaded parallel pad clamp shown in FIG. 1.
Figure 3:
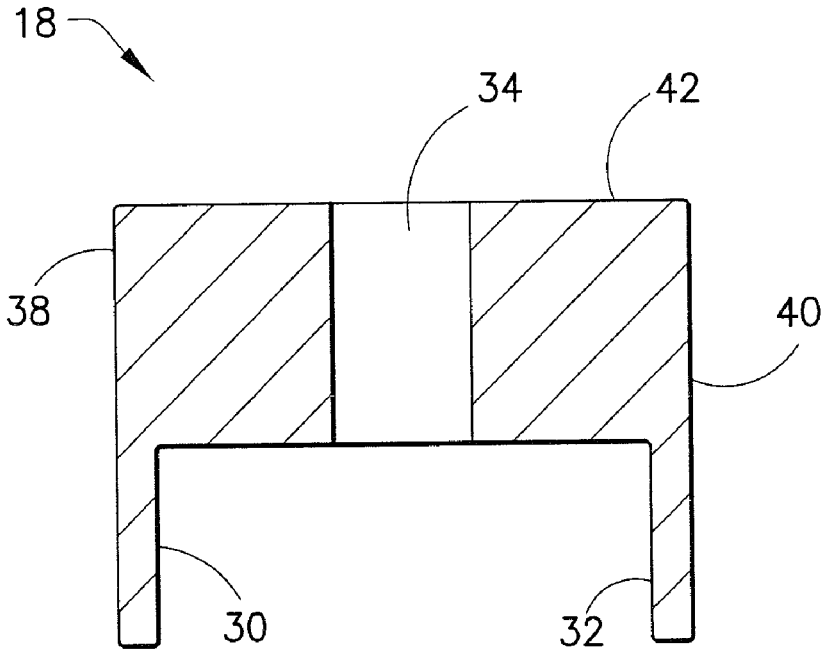
FIG. 3 is a cross section view of the upper pad shown in FIG. 2 taken along line 3-3.

Referring now also to FIGS. 2 and 3, the upper pad 18 comprises two conductor grooves 26, 28, two protruding tabs 30, 32, a fastener hole 34, and a protruding flange 36. The upper pad 18 may be a one-piece member fabricated from an electrically conductive material, such as metal for example.

The two conductor grooves 26, 28 are configured to receive the two conductors 12, 14, respectively. The conductor grooves 26, 28 provide surfaces which contact upper portions of the conductors 26, 28 under the spring biased clamping force between the upper pad 18 and the lower pad 20. The first conductor grove (or first upper groove) 26 is configured to contact the upper portion of the first conductor 12. The second conductor grove (or second upper groove) 28 is configured to contact the upper portion of the second conductor 14. The two conductor grooves 26, 28 are substantially parallel to each other and extend from a first end 38 of the upper pad 18 to an opposite second end 40 of the upper pad 18.

The two protruding tabs 30, 32 extend from the first end 38 and the second end 40, respectively, of the upper pad 18. Each of the protruding tabs 30, 32 extends from a portion of the ends 38, 40 between the conductor grooves 26, 28. Additionally, each of the protruding tabs 30, 32 extends away from a top side 42 of the upper pad 18 and in a direction substantially perpendicular to the conductor grooves 26, 28. The protruding tabs 30, 32 extend substantially parallel to each other and are opposite each other with a gap therebetween. The gap between the opposed protruding tabs 30, 32 is configured to accommodate a width of the lower pad 20.

The fastener hole (or upper hole) 34 extends from a center portion of the top side 42 between the conductor grooves 26, 28 and the protruding tabs 30, 32. The fastener hole 34 extends through the upper pad 18 substantially perpendicular to the protruding tabs 30, 32. The fastener hole 34 is suitably sized and shaped to receive the fastener 24. Additionally, the top side 42 (at an intersection of the fastener hole 34 and the top side 42) may serve as a stop feature for an end of the fastener 24.

The protruding flange 36 extends from an outer edge of the second conductor groove 28. The protruding flange 36 has a general duck bill shape and extends outward at a suitable angle to facilitate engagement, by providing a lead-in feature, with the second conductor 14.

Figure 4:
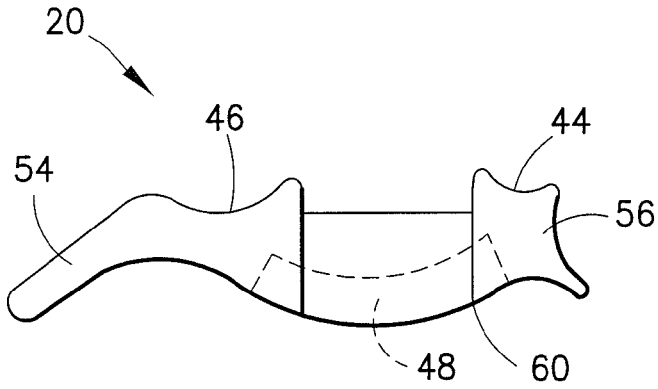
FIG. 4 is a side elevational view of a lower pad used in the spring loaded parallel pad clamp shown in FIG. 1.
Figure 5:
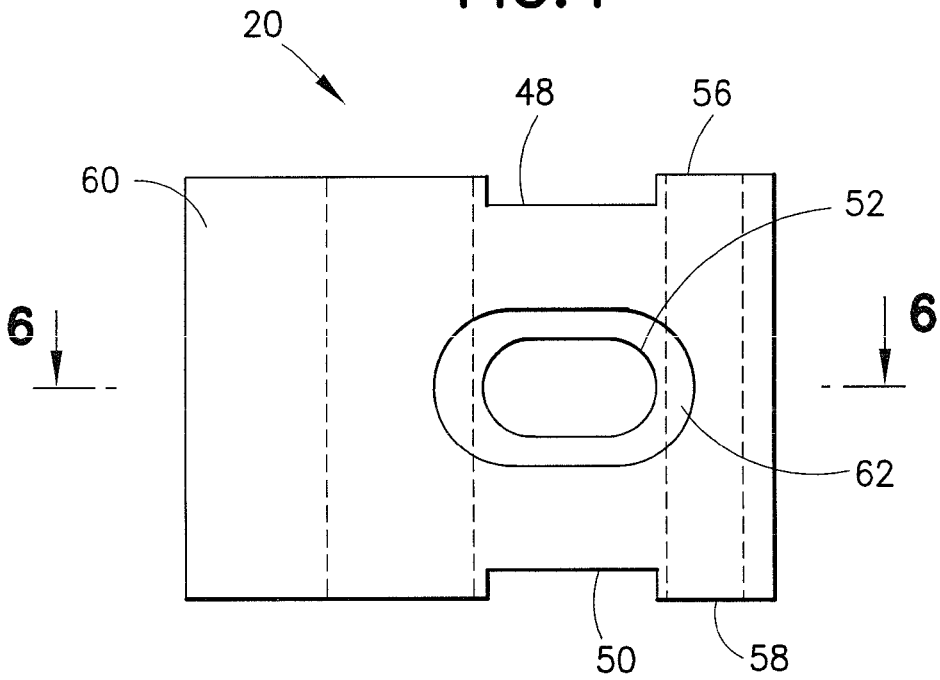
FIG. 5 is a bottom plan view of the lower pad shown in FIG. 4.
Figure 6:
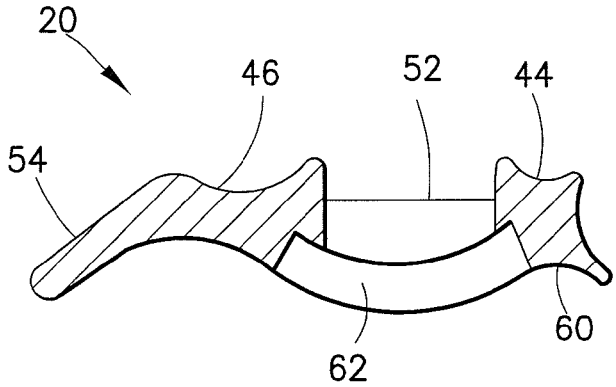
FIG. 6 is a cross section view of the lower pad shown in FIG. 4 taken along line 6-6.

Referring now also to FIGS. 4-6, the lower pad 20 comprises two conductor grooves 44, 46, two flat grooves 48, 50, an elongated counter bored hole 52, and a protruding flange 54. The lower pad 20 may be a one-piece member fabricated from an electrically conductive material, such as metal for example.

The two conductor grooves 44, 46 are configured to receive the two conductors 12, 14, respectively. The conductor grooves 44, 46 provide surfaces which contact lower portions of the conductors 12, 14 under the spring biased clamping force between the upper pad 18 and the lower pad 20. The first conductor grove (or first lower groove) 44 is configured to contact the lower portion of the first conductor 12. The second conductor grove (or second lower groove) 46 is configured to contact the lower portion of the second conductor 14. The two conductor grooves 44, 46 are substantially parallel to each other and extend from a first end 56 of the lower pad 20 to an opposite second end 58 of the lower pad 20. The conductor grooves 44, 46 of the lower pad 20 are configured to be aligned with the conductor grooves 26, 28 of the upper pad 18 when the pads 18, 20 are assembled together to form suitable receiving areas for the conductors 12, 14.

The two flat grooves 48, 50 extend along the first end 56 and the second end 58, respectively, of the lower pad 20. The flat grooves 48, 50 are configured to receive the protruding tabs 30, 32, respectively, of the upper pad 18. Each of the flat grooves 48, 50 extends from a bottom side 60 of the lower pad 20, between the conductor grooves 44, 46, and to an inner side of the lower pad 20. Additionally, each of the flat grooves 48, 50 extends along the first end 56 and the second end 58 in a direction substantially perpendicular to the conductor grooves 44, 46. The flat grooves 48, 50 extend along the opposite ends 56, 58 of the lower pad 20 and are substantially parallel to each other.

The elongated (or slotted) counter bored hole 52 extends from a center portion of the bottom side 60 between the conductor grooves 44, 46 and the flat grooves 48, 50. The elongated counter bored hole 52 extends through the lower pad 20 substantially perpendicular to the flat grooves 48, 50. The elongated counter bored hole 52 is suitably sized and shaped to receive the fastener 24 extending from the fastener hole 34 of the upper pad 18. The elongated hole 52 is oriented transverse to path of the fastener 24 (through the upper pad 18 and the lower pad 20). A counter bore feature 62 of the elongated counter bored hole 52 provides a surface, which serves as a spring seat, for supporting an end of the spring 22. The counter bore feature 62 intersects the bottom side 60 and extends thru a portion of the lower pad 20. The counter bore feature 62 (or cavity) has an oval or slot shape and receives a portion of the spring 22.

The protruding flange 54 extends from an outer edge of the second conductor groove 46. Similar to the protruding flange 36 on the upper pad 18, the protruding flange 54 on the lower pad 20 has a general duck bill shape. The protruding flange 54 extends, in a general mirrored image fashion to the protruding flange 36, outward at a suitable angle to facilitate engagement, by providing a lead-in feature, with the conductor 14.

Figure 7:
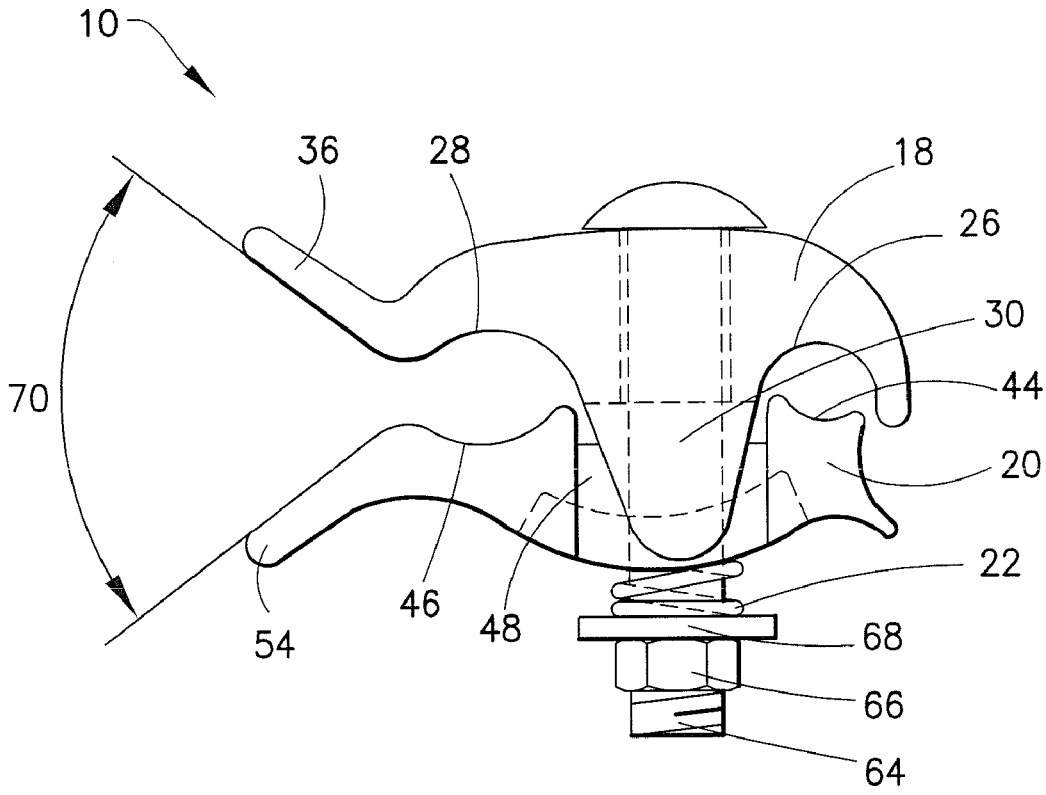
FIG. 7 is a side elevational view of the spring loaded parallel pad clamp shown in FIG. 1.
Figure 8:
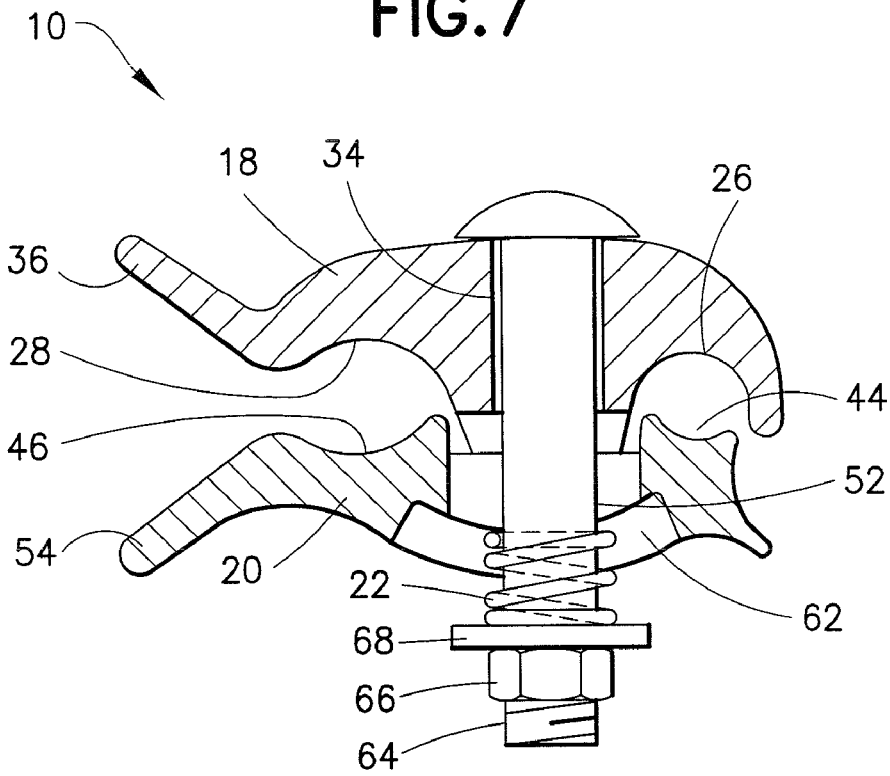
FIG. 8 is a cross section view of the spring loaded parallel pad clamp shown in FIG. 7.

Referring now to FIGS. 7 and 8, the upper pad 18 and the lower pad 20 are assembled together to form the spring loaded parallel clamp 10. The protruding tabs 30, 32 on the upper pad 18 overlap the lower pad 20, at the flat grooves 48, 50, which prevents the pads 18, 20 from rotating. However, it should be noted that the flat grooves 48, 50 are not required and the protruding tabs 30, 32 may overlap continuously flat ends of the lower pad to prevent the pads from rotating. The first conductor grooves 26, 44 are aligned to form a receiving area for the first conductor 12. The second conductor grooves 28, 46 are aligned to form a receiving area for the second conductor 14. The fastener 24, which may comprise a bolt 64 and a nut 66 for example, extends through the fastener hole 34 in the upper pad 18 and through the elongated counter bored hole 52 of the lower pad 20. The spring 22, which may be a compression coil spring for example, is fitted over an extending portion of the bolt 64, within the counter bore 62. The spring 22 may be captured by a washer 68 fitted between the nut 66 and the spring 22. It should be noted that although the figures illustrate the spring loaded parallel pad clamp 10 as comprising a single spring 22, any suitable number of springs may be provided.

With the two pads 18, 20 assembled together having the two protruding flanges 36, 54 on the same side, the protruding flanges 36, 54 provide an opening (forming a general "V" shape or generally acute angle 70) for the conductor 14 to be easily installed. The spring 22 captured between the counter bore 62 and the washer 68 applies pressure against the lower pad 20 therefore forcing the upper and lower pads 18, 20 together (or biasing the pads 18, 20 towards each other). The upper pad 18 and the lower pad 20 can be separated by overcoming the spring pressure to allow for installation of the first conductor 12 between the pads 18, 20 at the conductor grooves 26, 44. As the two pads 18, 20 are forced against each other, pressure is created on the first conductor 12 (securing the first conductor 12 between the conductor grooves 26, 44). This allows the first conductor 12 to be held between the conductor grooves 26, 44 while the second conductor 14 is installed. As the second conductor 14 is led in (by the protruding flanges 36, 54) towards the second conductor grooves 28, 46, the elongated hole 52 allows the lower pad 20 to move a certain distance. The lower pad 20 can pivot (relative to the upper pad 18) around the fastener 24 as constrained by the oval shape of the elongated hole 52. The movement of the lower pad 20 occurs while keeping the spring 22 captive, and the upper and lower pads 18, 22 separate (proximate the conductor grooves 28, 46) a suitable distance to allow installation of the second conductor 14 between the second grooves 28, 46 of the upper and the lower pad 18, 20.

It should be noted that although the figures illustrate the upper pad 18 comprising the fastener hole 34 and the lower pad 20 comprising the elongated counter bored hole 52, alternate embodiments having any combination of thru holes, counter bored holes, cylindrical holes, or elongated holes may be provided.

The installation described above may be accomplished by attaching a utility lineman's hot stick 16 to an end of the fastener (and/or the nut 66) extending from the bottom side of the lower pad; such as by screwing on to the end of the bolt 64 for example. The disclosed configuration provides a spring loaded parallel clamp that can be easily installed (when compared to conventional configurations) to connect a tap line to an overhead power distribution line on a utility pole using a utility lineman's hot stick.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector comprising:

an upper pad comprising a first upper groove, a second upper groove, and an upper hole, wherein the upper hole extends through the upper pad between the first upper groove and the second upper groove, and wherein the first upper groove is configured to contact a first conductor when the first conductor is in an installed position;

a lower pad comprising a first lower groove, a second lower groove, and an elongated hole, wherein the elongated hole extends through the lower pad between the first lower groove and the second lower grove, and wherein the first lower groove is configured to contact the first conductor when the first conductor is in the installed position;

a single fastener extending between the first and second upper grooves and between the first and second lower grooves, wherein the single fastener extends through the upper hole and the elongated hole; and a spring between an end of the fastener and the lower pad, wherein an end of the spring is proximate the elongated hole, and wherein the spring is configured to bias the upper pad and the lower pad towards each other;

wherein the lower pad is configured to be pivotable around the fastener, and relative to the upper pad, at the elongated hole.

2. The electrical connector of claim 1 wherein the first upper groove and the second upper groove are substantially parallel to each other.

3. The electrical connector of claim 1 wherein the upper pad and the lower pad each further comprise an angled flange extending from the second upper groove and the second lower groove, respectively, and wherein the flanges are configured to provide a lead-in feature for a conductor.

4. The electrical connector of claim 1 wherein the spring is spaced from the upper pad.

5. The electrical connector of claim 1 wherein the first upper groove and the second upper groove are substantially parallel to each other, wherein the upper pad and the lower pad each further comprise an angled flange extending from the second upper groove and the second lower groove, respectively, and wherein the flanges are configured to provide a lead-in feature for a conductor.

6. The electrical connector of claim 5 wherein the spring is spaced from the upper pad.

7. The electrical connector of claim 6 wherein the upper pad and the lower pad are each one-piece members.

8. The electrical connector of claim 1 wherein the first lower groove and the second lower groove are substantially parallel to each other.

9. The electrical connector of claim 1 wherein the upper hole is substantially perpendicular to the first upper groove and the second upper groove.

10. The electrical connector of claim 1 wherein the elongated hole is substantially perpendicular to the first lower groove and the second lower groove.

11. The electrical connector of claim 1 wherein the upper pad further comprises a pair of tabs extending from opposite ends of the upper pad, wherein a gap between the tabs accommodates a width of the lower pad.

12. The electrical connector of claim 11 wherein the lower pad further comprises flat grooves extending along opposite ends of the lower pad, wherein the flat grooves receive the tabs of the upper pad.

13. The electrical connector of claim 1 wherein the elongated hole further comprises a counter bore feature.

14. An electrical connector clamp comprising:

an upper pad comprising a first flange, wherein a first side of the upper pad is configured to contact an upper portion of a first conductor and an upper portion of a second conductor;

a lower pad comprising a second flange, wherein a first side of the lower pad iS configured to contact a lower portion of the first conductor and a lower portion of the second conductor, and wherein the first side is opposite the upper pad;

a fastener connected between the upper pad and the lower pad; and a spring at a second side of the lower pad connected to the fastener, wherein the second side of the lower pad is opposite the first side of the lower pad;

wherein the clamp is configured to receive the second conductor between the first flange and the second flange against a bias of the spring, and wherein the clamp is configured to secure the first conductor and the second conductor by a clamping force only between the upper pad and the lower pad.

15. The electrical connector clamp of claim 14 wherein the fastener extends through a hole of the upper pad and an elongated hole of the lower pad.

16. The electrical connector clamp of claim 15 wherein the elongated bole comprises a counter bore feature.

17. The electrical connector clamp of claim 16 wherein the counter bore feature supports an end of the spring.

18. The electrical connector clamp of claim 14 further comprising a washer between the spring and the fastener.

19. The electrical connector clamp of claim 14 wherein the upper pad and the lower pad each further comprise grooved areas, and wherein the grooved areas form a first conductor receiving area and a second conductor receiving area.

20. The electrical connector clamp of claim 19 wherein the fastener extends between the first conductor receiving area and the second conductor receiving area.

21. The electrical connector clamp of claim 14 wherein the fastener further comprises a bolt and a nut.

22. The electrical connector clamp of claim 14 wherein the upper pad and the lower pad are each one-piece members.

23. The electrical connector clamp of claim 14 wherein the clamp is configured to be attached to a utility linesman's hot stick.

24. A method of manufacturing an electrical connector:

providing an upper pad comprising a first upper groove, a second upper groove, and an upper hole, wherein the upper pad is a one-piece member, and wherein the upper hole extends through the upper pad between the first upper groove and the second upper groove;

providing a lower pad comprising a first lower groove, a second lower groove, and an elongated hole, wherein the lower pad is a one-piece member, and wherein the elongated hole extends through the lower pad between the first lower groove and the second lower grove;

connecting a fastener to the upper pad and the lower pad, wherein the fastener extends through the upper hole and the elongated hole; and connecting a single spring between the fastener and the lower pad, wherein the lower pad is between the spring the upper pad, and wherein the electrical connector is configured such that only the single spring provides a bias on the upper pad and the lower pad;

wherein the lower pad is configured to be pivotable around the fastener, and relative to the upper pad, at the elongated hole.

25. The method of claim 24 wherein the connecting of the spring further comprises connecting the spring between the fastener and the lower pad and spaced from the upper pad.

* * * * *